US005915601A

United States Patent [19]

Ullrich et al.

[11] Patent Number: 5,915,601

[45] Date of Patent: Jun. 29, 1999

[54] SCORED DISPENSING LINER

[75] Inventors: Jeffrey F. Ullrich, Western Springs; Walter L. Johnson, Northbrook, both of Ill.

[73] Assignee: Phoenix Closures, Inc., Naperville, Ill.

[21] Appl. No.: 08/761,481

[22] Filed: Dec. 6, 1996

[51] Int. Cl.[6] ..... B65D 17/28

[52] U.S. Cl. ..... 222/541.6; 220/258; 220/259; 220/268

[58] Field of Search ..... 222/541.6; 215/232; 220/266, 268, 359, 254, 256, 258, 259

[56] References Cited

U.S. PATENT DOCUMENTS

| | | | |
|---|---|---|---|
| 1,068,446 | 7/1913 | Pullen et al. . | |
| 1,805,003 | 5/1931 | Newman | 220/268 |
| 2,123,906 | 7/1938 | Masbach et al. . | |
| 2,974,815 | 3/1961 | Driscoll . | |
| 3,101,877 | 8/1963 | Driscoll . | |
| 3,275,203 | 9/1966 | Nossal et al. | 222/541.6 X |
| 3,355,058 | 11/1967 | Asbury | 222/541.6 X |
| 3,767,076 | 10/1973 | Kennedy . | |
| 3,815,314 | 6/1974 | Pollock et al. . | |
| 3,928,109 | 12/1975 | Pollock et al. . | |
| 3,973,719 | 8/1976 | Johnson et al. . | |
| 4,020,969 | 5/1977 | Ando . | |
| 4,078,694 | 3/1978 | Gnyp et al. | 220/268 |
| 4,126,244 | 11/1978 | Elser | 220/268 |
| 4,530,440 | 7/1985 | Leong . | |
| 4,562,936 | 1/1986 | Deflander | 220/268 |
| 4,693,390 | 9/1987 | Hekal . | |
| 4,754,890 | 7/1988 | Ullman et al. . | |
| 4,771,937 | 9/1988 | Kamada et al. . | |
| 4,934,544 | 6/1990 | Han et al. . | |
| 4,960,216 | 10/1990 | Giles et al. . | |
| 4,988,004 | 1/1991 | Intini . | |
| 5,004,111 | 4/1991 | McCarthy . | |
| 5,121,845 | 6/1992 | Blanchard . | |

*Primary Examiner*—Kevin P. Shaver
*Attorney, Agent, or Firm*—Welsh & Katz. LTD.

[57] ABSTRACT

A dispensing liner for a container includes a seal element having a sealing edge and a central portion. The sealing edge is engaged with and sealed to a land portion of a container to close the opening in the container. The seal element includes a preferentially formed score line having a first frangible portion and a second portion defining a removable tab. The first frangible portion and the second portion are formed within the central portion of the liner with the second portion in spaced relation and adjacent to the sealing edge. The liner is opened along at least the first frangible portion to define a dispensing port. The periphery of the liner, at the sealing edge, forms a seal with the cap when the cap is engaged with the container after the liner is opened. The tab can be removed from the liner leaving the sealing edge in place to effect a seal between the liner and the cap.

14 Claims, 2 Drawing Sheets

SCORED DISPENSING LINER

FIELD OF THE INVENTION

This invention relates to a dispensing liner for a container. More particularly, the invention relates to a dispensing liner for a container which liner is sealed about the land surface of the container and which includes a non-seal interfering, preferentially formed score line defining dispensing port.

BACKGROUND OF THE INVENTION

Plastic containers are used for packaging and storing a wide variety of products. Such containers are in particularly wide use for packaging and storing food products, particularly powdered food products such as coffee creamer and the like. It is also often desirable to include a dispensing-type arrangement in containers which are used to store such powered food products.

In a typical package arrangement, the plastic container has a threaded neck portion that is configured to receive a complimentarily threaded cap. Generally, a seal is placed on the container, over the container land surface, and sealed thereto. The land surface is that portion of the container atop the neck portion, on which the container cap rests when it is threaded to the container. The seal may be formed of paper, plastic, foil or a combination, e.g., a laminate, thereof.

The seal is placed on the container for a number of reasons. One function of the seal is to maintain the food product quality standards by sealing the food product to prevent or retard spoilage, such as by oxidation. In addition, such seals often provide tamper or pilfer indication, thereby assuring both the manufacturer and the consumer that the food product is unadulterated.

Known seals are typically broken, and the seal fully, or at least partially removed, to access the contents of the container. Thus, while such a seal provides the benefit of maintaining the product fresh when it is stored, for example, on a store shelf, once it is opened and the seal is broken, the shelf life of the product may be greatly reduced.

A wide variety of dispenser-type arrangements are known in the art. Dispensing configurations include the commonly recognized shaker-type arrangement. Also known are dispensing openings or ports which permit, for example, a spoon to be inserted through the opening to remove a measure quantity of the stored material.

In one known type of dispenser design, a perforated cap is positioned over the seal, and snapped onto the container. In use, the perforated cap is removed from the container, the seal is then broken and the perforated cap replaced on the container. It will be recognized that in such an arrangement, the perforated cap my be easily misplaced, thus effectively losing any controlled dispensing capability for the container.

Another dispenser design arrangement includes a guillotine-like rotating slide that has one or more openings therein. The slide may include a removable portion thus providing a seal for the container prior to first use thereof. In a variation of the guillotine-like arrangement, the container may include a seal positioned between the rotating slide portion and the container to provide a seal for the container prior to first use. Notwithstanding that this type of dispensing arrangement is satisfactory, it is readily seen that such an arrangement can be quite costly given that most such containers are disposed of after use.

Accordingly, there continues to be a need for a cost effective container seal which provides an extended product shelf life by maintaining the product fresh during storage and shipment, which liner maintains its sealing characteristics after first use.

SUMMARY OF THE INVENTION

A dispensing liner for a container includes a seal element having a preferentially formed score line having a first frangible portion and second portion defining a tab in the liner. The liner is used with a container configured to store for example a powdered or granular material therein. The container has a peripheral land surface defining an opening in the container. The liner is sealed on the land surface, spanning the opening of the container.

The seal element has a sealing edge and a central portion. The sealing edge is engaged with and sealed to the land portion to close the container opening. The seal element includes a preferentially formed score line having a first frangible portion and a second portion. The first frangible portion and the second portion are formed entirely within the central portion of the liner and define a tab. Preferably, the second portion is adjacent to and in spaced relation from the sealing edge. The liner is configured for opening along at least the first frangible portion to define a dispensing port. In a preferred configuration, the tab is removable from the liner.

After the liner seal is broken and the cap is engaged with the container, the sealing edge forms a seal with the cap to seal the container.

The score line may be formed so that the first frangible portion and the second portion are contiguous with one another. Alternately, the score line may be formed so that the first frangible portion and the second portion define at least one gap therebetween. Each the first frangible portion and the second portion may be formed as a continuous line or as a series of discrete, intermittent score line elements. Alternately, a portion of the score line can be formed as discrete perforated line segments.

Other features and advantages of the present invention will be apparent from the following detailed description, the accompanying drawings, and the appended claims.

DETAILED DESCRIPTION OF THE PREFERRED EMBODIMENTS

Figure 1:
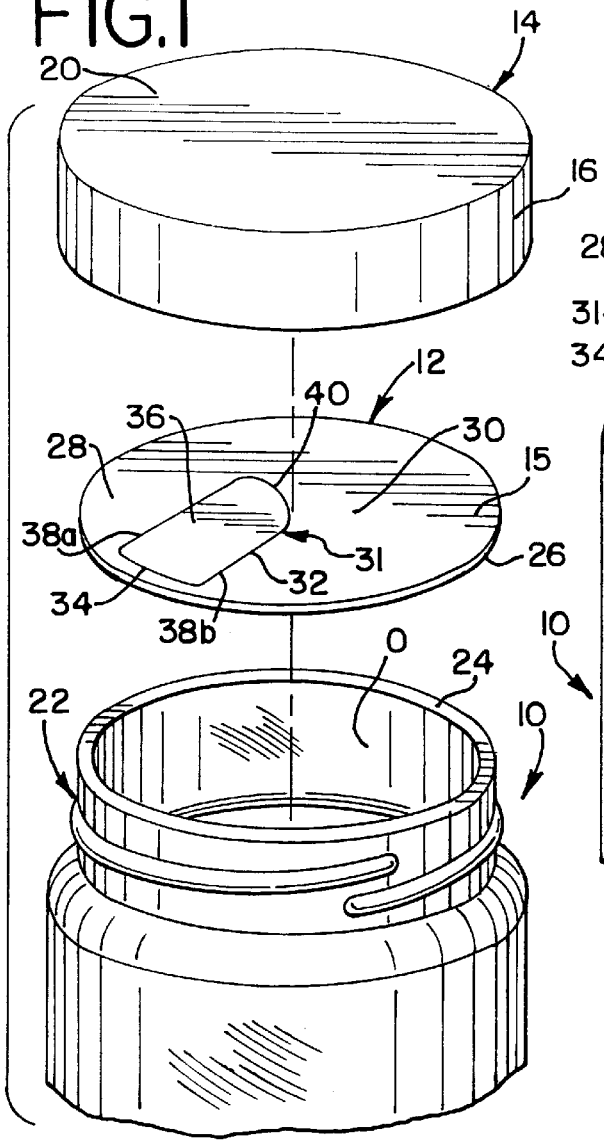
FIG. 1 is an exploded perspective view of a container illustrated with a scored dispensing liner embodying the principles of the present invention, and a cap.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Figure 3:
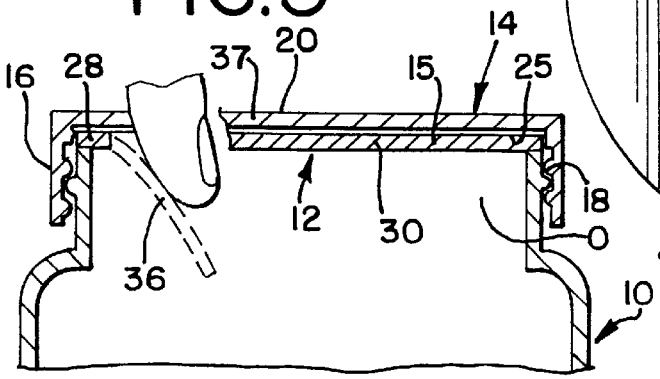
FIG. 3 is a partial cross-sectional view of the container and dispensing liner taken along line 3—3 of FIG. 2, illustrated with a user's finger (out of context) pushing the tab, shown in phantom lines, inward of the container for accessing the contents thereof, and with the cap positioned on the container.

Referring now to the figures, there is shown a container 10 having a dispensing liner 12 positioned thereon, which liner 12 embodies the principles of the present invention. The container 10 is illustrated with a cap 14 thereon (FIG. 3). The cap 14 includes a skirt portion 16 having internally formed threads 18 and a top wall portion 20.

The container 10 includes a threaded neck portion 22, the top of which forms a land surface 24. The threaded neck portion 22 threadedly engages the cap threads 18 to secure the cap 14 to the container 10. The land surface 24, which defines an opening O in the container 10, is that portion of the container 10 which contacts the inside peripheral surface 25 of the cap top wall portion 20. The land surface 24 defines a sealing surface which, along with the top wall portion 20 and the liner 12 form a seal which isolates the container contents from the environs when the cap 14 is positioned on the container.

The liner 12 includes a seal element 15 and is positioned on the container 10, spanning the opening O. The seal element 15 includes a sealing edge 28 and a central portion 30. Accordingly, the peripheral edge 26 of the liner 12 will typically align with the land surface 24. The sealing edge 28 is affixed to the land surface 24 by, for example, an adhesive.

In a typical packaging operation, the liner 12 is positioned on the container 10 after the container 10 is filled by a food packager. Once the container 10 is sealed with the liner 12, the cap 14 is threaded onto the container 10. Even if the cap 14 is unscrewed, the liner 12 prevents access to the contents of the container 10, until the liner 12 is broken or opened.

The liner 12 central portion 30 includes a preferentially formed score line 31 having a first frangible portion 32 and a second portion 34. The first line portion 32 is frangible and defines, in part, a tab 36. In a current embodiment, the first line portion 32 is formed in a U-shape having elongated leg portions 38*a,b* opposing one another, and a semicircular portion 40 extending between the leg portions 38*a,b*. The second line portion 34 extends between the leg portions 38*a,b* in opposing relation to the semicircular portion 40, and forms the base of the tab 36. Accordingly, the tab 36 is defined by the score line portions 32, 34. The tab 36 defines a dispensing opening or port 37 in the liner 12. In a preferred embodiment, the second score line portion 34 is frangible so that the entirety of the tab 36 is removable from the liner 12 and defines an unobstructed port 37.

Figure 4:
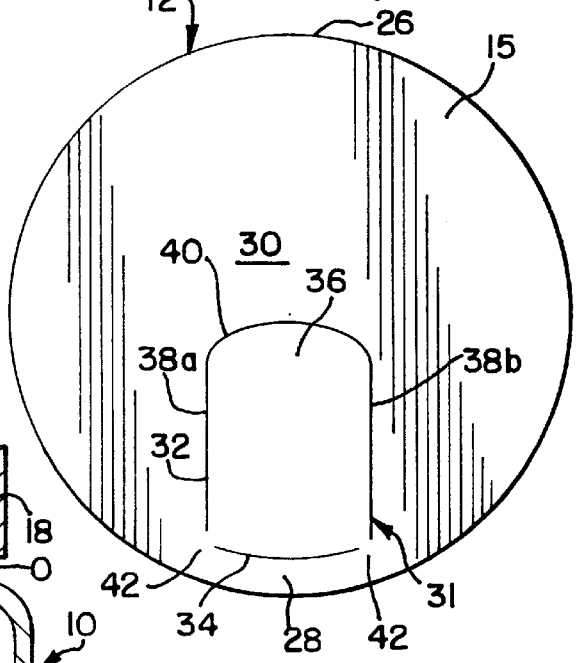
FIG. 4 is a top plan view of the dispensing liner illustrated with gaps between the first and second line portions.

The score line portions 32, 34 are formed in the central portion 30 of the liner 12 and are positioned so as to not interfere with the sealing edge 28. As best seen in FIGS. 3–4, the score line portions 32, 34 are oriented with the second portion 34 thereof adjacent and in spaced relation to the sealing edge 28, such that neither of the score line portions 32, 34 extend into the sealing edge 28.

The score line 31 is preferentially formed in the liner 12. The first portion 32 is formed deeper into the liner 12 relative to the second portion 34. In such an arrangement, the first portion 32 is configured to fracture or break prior to the second portion 34 when the portions 32, 34 are subject to stress, as by pressure on the tab 36 by a user's finger.

In a current embodiment, the liner 12 is formed of a coated or laminated fibrous (e.g., paper or pulp based) material, and has a thickness t of about 10 thousandths of an inch (10 mils), and a score depth into the liner 12 of about one-half of the liner thickness, or about 5 mils, ±20%. Liners 12 may be formed having thicknesses in a range of about 6 mils to about 20 mils, with score line depths of about one-half of the liner 12 thickness, ±20%. The liner 12 may of course be formed of other materials, and may have varying thicknesses and score line depths, as will be recognized by those skilled in the art.

Figure 2:
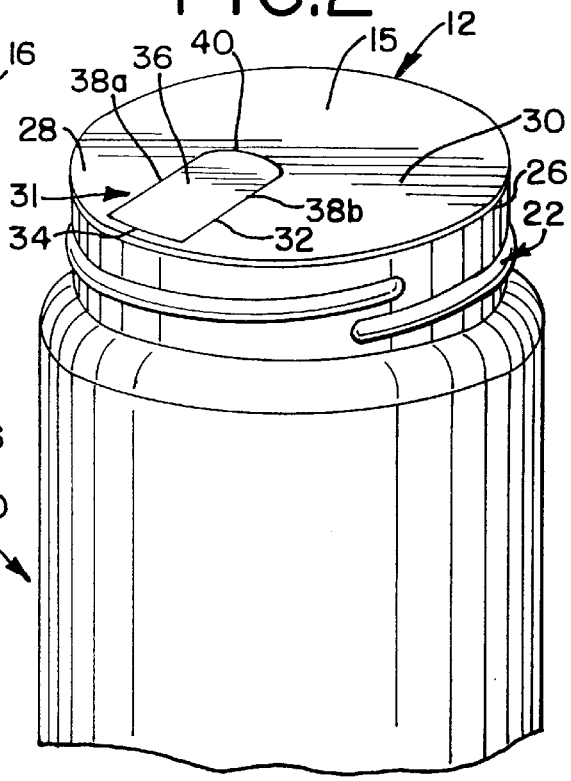
FIG. 2 is a perspective view similar to FIG. 1, illustrating the container with dispensing liner positioned thereon, the cap being removed for clarity of illustration.

The score line 31 may be formed so that the first frangible portion 32 and the second portion 34 are contiguous with one another, as illustrated in FIGS. 1–2. Alternately, the score line 31 may be formed so that the first frangible portion 32 and the second portion 34 define at least one gap 42 therebetween, as illustrated in FIG. 4. Each the first frangible portion 32 and the second portion 34 may be formed as a continuous line or as a series of discrete, intermittent score line elements or segments.

Figure 5A:
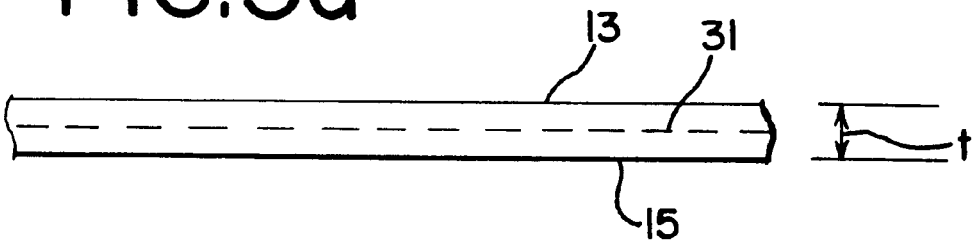
FIGS. 5*a–c* illustrate various score line formations as viewed from a cross-section taken along the score line, where FIG. 5*a* illustrating a score line formed from a top surface of the liner, FIG. 5*b* illustrating a score line formed from a bottom surface of the liner, and FIG. 5*c* illustrating a score line formed from both the top and bottom surfaces of the liner.
Figure 5B:
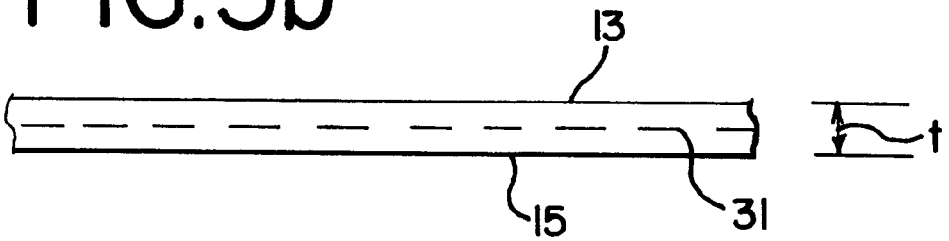
Figure 5C:
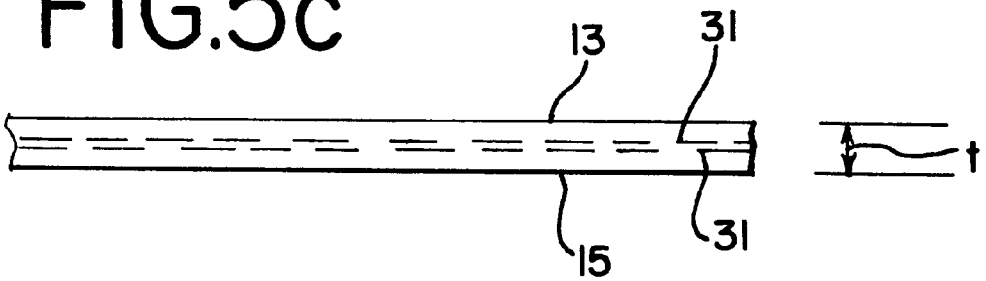

As shown in FIG. 5*a*, the score line 31 can be formed as a continuous score in a top surface 13 of the liner 12. Alternately, as illustrated in FIG. 5*b*, the score line 31 can be formed in a bottom surface 15 of the liner 12, or as shown in FIG. 5*c*, the score line 31 can be formed in both the top surface 13 and the bottom surface 15 of the liner 12. It will be recognized by those skilled in the art that the score configurations of FIGS. 5*a–c* can each be formed as a continuous line or as a series of discrete, intermittent score line element or segments.

Figure 6:
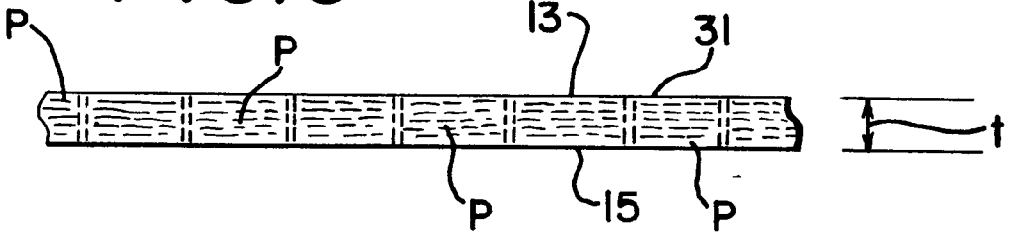
FIG. 6 illustrates a cross-section similar to FIGS. 5*a–c*, showing a score lien formed by a series of discrete, through liner perforations.

In an alternate form, as illustrated in FIG. 6, the score line 31 can be formed of perforated line segments P. The perforated segments are formed by a through liner 12 cut, which cut can be made from the top surface 13 or the bottom surface 15 of the liner 12. It will be recognized by those skilled in the art that the perforated segments P are discrete, intermittent segments P which are formed by cutting through the liner 12.

In use, a consumer removes the cap 14 from the container. Using pressure, as by pressing with a finger, the tab 36 is pushed inward. The pressure on the tab 36 causes the first portion 32 of the score line 31 to fracture. The tab 36 can then be manipulated upward. In a preferred embodiment, the tab 36 can be removed by pulling the tab 36 which severs the tab 36 from the liner 12 at the second portion 34 of the score line 31.

Advantageously, the present design does not adversely affect the sealing capabilities of the container-liner-cap 10-12-14 arrangement. Referring to FIG. 3, the tab 36 does not form part of the sealing edge 28. Rather, the tab 36 is formed entirely within the central portion 30 of the liner 12. Thus, even when the tab 36 is removed, the sealing edge 28 remains intact and abuts the top wall portion 20 of the cap 14 to effect a seal therebetween. Thus, the contents of the container 10 will remain fresh, and spoilage will be retarded.

Notwithstanding the U-shape configuration of the tab 36 and the illustrated score line 31, it will be recognized by those skilled in the art that the tab 36 can take many different shapes to achieve a variety of specific, desired purposes. The tab 36 may, for example, be shaped so as to accommodate a measuring spoon, a tea spoon or the like. Likewise, the thickness of the liner 12 and the scoring depth of the line portions 32, 34 can be varied to achieve specific desired results.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A dispensing liner for use with an associated container, the container configured to store a material therein and to have the material dispensed therefrom, the container having a peripheral land surface defining an opening to access the material in the container, the land surface defining a sealing surface and configured for engagement with an associated cap, the liner comprising:

a seal element having a sealing edge and a central portion, said sealing edge adapted to engage the land surface of the associated container to close the opening defined thereby, said seal element including a preferentially formed score line having a first frangible portion and a second portion defining a tab, said first frangible portion and said second portion being formed within said central portion, said second portion being adjacent and in spaced relation to said sealing edge, said seal element being configured for opening along at least said first frangible portion to define a dispensing port, wherein when the cap is engaged with the container, said sealing edge forms a seal with the associated cap.

2. The dispensing liner in accordance with claim 1 wherein said first frangible portion and said second portion define a tab.

3. The dispensing liner in accordance with claim 1 wherein said second portion is frangible.

4. The dispensing liner in accordance with claim 1 wherein said first frangible portion and said second portion are contiguous with one another.

5. The dispensing liner in accordance with claim 1 wherein said first frangible portion and said second portion define at least one gap therebetween.

6. The dispensing liner in accordance with claim 5 wherein said first frangible portion and said second portion define two gaps therebetween.

7. The dispensing liner in accordance with claim 1 wherein at least one of said first frangible portion and said second portion is a continuous score line.

8. The dispensing liner in accordance with claim 1 wherein at least a portion of said score line is perforated.

9. The dispensing liner in accordance with claim 1 wherein said preferentially formed score line has a depth at said first frangible portion that is greater than a depth of said score line at said second portion.

10. A dispensing liner for use with an associated container, the container configured to store a material therein and to have the material dispensed therefrom, the container having a peripheral land surface defining an opening to access the material in the container, the land surface defining a sealing surface and configured for engagement with an associated cap, the liner comprising:

a seal element having a sealing edge and a central portion, said sealing edge adapted to engage the land surface of the associated container to close the opening defined thereby, said seal element including a preferentially formed score line defining a first frangible portion having a depth and a second portion having a depth that is less than said depth of said score line defining said first frangible portion, said first frangible portion and said second portion being formed within said central portion and defining an opening tab formed entirely within said central region, said second portion being adjacent and in spaced relation to said sealing edge and said first portion being formed inwardly thereof relative to said central region, wherein each said first and second portions are spaced from said sealing edge, said seal element being configured for opening along at least said first frangible portion to define a dispensing port, wherein when the cap is engaged with the container, said sealing edge forms a seal with the associated cap.

11. The dispensing liner in accordance with claim 1 wherein said second portion is frangible.

12. The dispensing liner in accordance with claim 1 wherein said first frangible portion and said second portion are contiguous with one another.

13. The dispensing liner in accordance with claim 1 wherein said first frangible portion and said second portion define at least one gap therebetween.

14. The dispensing liner in accordance with claim 5 wherein said first frangible portion and said second portion define two gaps therebetween.

* * * * *